US006315593B1

(12) United States Patent
Bentley et al.

(10) Patent No.: US 6,315,593 B1
(45) Date of Patent: Nov. 13, 2001

(54) MULTIPLE GANG ELECTRICAL CONNECTOR ASSEMBLY

(76) Inventors: James K. Bentley, P.O. Box 2848; Michael S. O'Keefe, P.O. Box 2992, both of Paso Robles, CA (US) 93447; Richard G. Davidson, 1690 El Camino Real, Atascadero, CA (US) 93442

( * ) Notice: Subject to any disclaimer, the term of this patent is extended or adjusted under 35 U.S.C. 154(b) by 0 days.

(21) Appl. No.: 09/816,702

(22) Filed: Mar. 26, 2001

(51) Int. Cl.[7] ..... H01R 13/625
(52) U.S. Cl. ..... 439/346
(58) Field of Search ..... 439/346, 102

(56) References Cited

U.S. PATENT DOCUMENTS 2,792,561 * 5/1957 Cohen ..... 439/651
4,061,409 * 12/1977 Bealmear ..... 439/346
4,627,681 * 12/1986 Hong ..... 439/263
5,316,493 * 5/1994 Sowers ..... 439/346
5,641,298 * 6/1997 Holloway ..... 439/346

* cited by examiner

*Primary Examiner*—Neil Abrams
(74) *Attorney, Agent, or Firm*—Charles C. Logan, II

(57) ABSTRACT

A multi-gang electrical connector assembly for detachable connection to a conventional wall outlet electrical receptacle. It has a housing with two pairs of vertically spaced blade prongs extending from its rear wall. Each set of blade prongs also has its own ground prong extending rearwardly therebelow. The front wall of the housing has two vertically spaced horizontally oriented lines of pairs of laterally spaced electrical plug apertures. Each pair of laterally spaced electrical plug apertures also has a ground prong aperture. There is a shaft having a knob on its end that extends through one of the side walls of the housing at a predetermined height above each of the respective horizontal lines of electrical plug apertures. There are gripping means on each of the shafts for gripping the top edge of conventional blade prongs of male electrical plugs to keep the male electrical plug rigidly connected to the multiple gang electrical connector assembly.

11 Claims, 3 Drawing Sheets

MULTIPLE GANG ELECTRICAL CONNECTOR ASSEMBLY

BACKGROUND OF THE INVENTION

The invention relates to an electrical connector and more specifically to a multiple gang electrical connector assembly for detachable connection to a conventional wall outlet electrical receptacle.

Conventional wall outlet electrical receptacles do not have any structure for locking them to the male electrical plug that is found on the end of an electrical cord of an electrical appliance or electrical tool. When a vacuum cleaner is used either in the home or a workplace the male electrical plug will generally pull out of the wall outlet electrical receptacle several times during operation. Likewise when someone is using an electrical tool while they are moving it about its male electrical plug will pull out of the wall outlet electrical receptacle.

It is also frequently desirable to insert more than two electrical plugs into a standard wall electrical receptacle. The Alemaghides U.S. Pat. No. 2,454,024; the Cohen U.S. Pat. No. 2,792,561; the Horwinski U.S. Pat. No. 3,997,225; and the Lee U.S. Pat. No. 5,211,584 Disclose multiple electrical receptacle units adapted to be attached to a wall-mount receptacle. None of these disclose structure for locking the male electrical plug of a tool or appliance to the multiple electrical receptacle unit.

The Ballmer U.S. Pat. No. 4,061,409 discloses a releasable locking means for a two-part electrical connector member for preventing the accidental separation of the two body members when they are joined in electrical engagement. The use of the releasable locking means requires that one of the blade prongs on the male electrical plug have a cutaway portion thereby making it non-operational with a conventional male electrical plug.

The Sowers U.S. Pat. No. 5,316,493 discloses an electrical connection between the male connector on an electrical cord and a female electrical connector either on the end of an electrical cord or in an electrical outlet socket. Necessary structure for this device to operate requires that the ground prong have a notch therein and this structure therefore would not work with a conventional male electrical plug.

It is an object of the invention to provide a novel multiple gang electrical connector assembly that can be rigidly connected to a wall outlet electrical receptacle.

It is also an object of the invention to provide a novel multiple gang electrical connector assembly that has a locking mechanism for securing the male electrical plug of an electrical appliance or tool thereto.

It is another object of the invention to provide a novel multiple gang electrical connector assembly that is economical to manufacture and market.

It is a further object of the invention to provide a novel multiple gang electrical connector assembly that does not require any modification to the blade prongs of a conventional male electrical plug.

It is also an object of the invention to provide a novel multiple gang electrical connector assembly that allows a male electrical plug to be quickly and easily locked therein or released therefrom.

It is another object of the invention to provide a novel multiple gang electrical connector assembly that eliminates the danger of a partial pullout of a male electrical plug in areas frequented by small children.

SUMMARY OF THE INVENTION

The multiple gang electrical connector assembly has a housing having a pair of vertically spaced sets of blade prongs and their respective ground prongs extending from the rear wall of the housing. These members are inserted into a conventional wall outlet electrical receptacle. The screw of that wall outlet electrical receptacle would have been removed previously and a much longer screw would be passed through the front wall of the housing and screwed into wall outlet electrical receptacle to rigidly secure it thereto.

A plurality of pairs of laterally spaced electrical plug apertures are formed in the front wall of the housing and each pair of laterally spaced electrical plug apertures has its own ground prong aperture. The laterally spaced electrical plug apertures are also aligned in two vertically spaced horizontally oriented lines. For manufacturing purposes it may be more economical to have each horizontal line of electrical plug apertures formed in its own module housing.

Each of the module housings would have an upper conductor bar, a lower conductor bar and a ground conductor bar. These would electrically tie the respective electrical plug apertures together and also the respective ground prongs together.

Spaced above and extending outwardly from the housing is a horizontally oriented shaft for each of the module housings. A knob is mounted on the front end of these shafts and their rear ends would be supported by structure within the housing. Each shaft would have a plurality of rings or annular shoulders laterally spaced from each other by reduced diameter shaft areas or annular grooves. The rings or annular shoulders have a transversely extending groove or channel along their periphery that aligns with one of the blade prongs for each of the male electrical plugs. The other blade prong would align with the reduced diameter shaft area or annular grooves. The spacing of the axis of the shaft above the electrical apertures in the front wall of the housing is a predetermined height thereabove so that a small rotation of the knob on the end of the shaft will take the rings or annular shoulders into locking engagement or out of locking engagement with the top edge of the respective blade prong on its male electrical plug. The radially extending arm connected to the shaft has its rotation halted when it contacts the stop pins at the respective lock and unlocked positions.

DESCRIPTION OF THE PREFERRED EMBODIMENT

Figure 2:
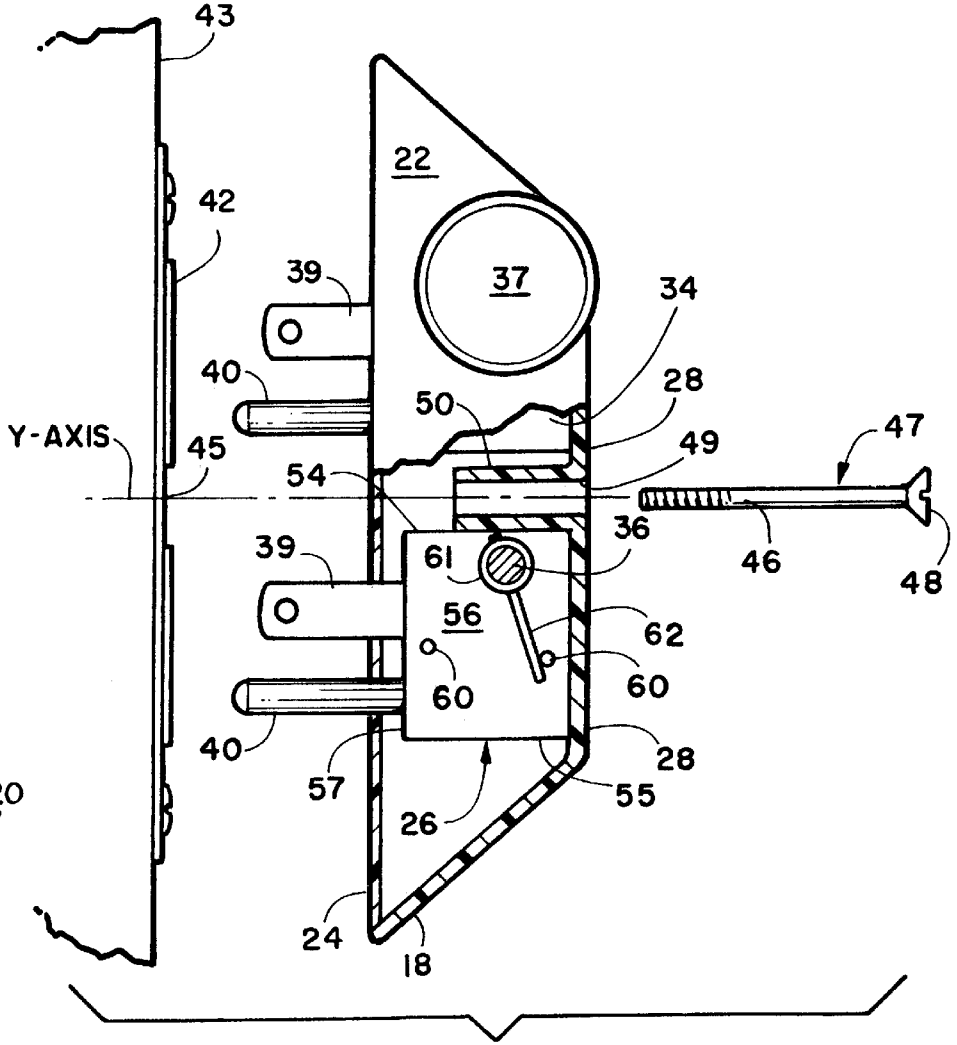
FIG. 2 is an exploded side elevation view showing the six gang wall outlet aligned with a wall outlet electrical receptacle and having portions of the housing of the six gang wall outlet broken away for clarity.
Figure 1:
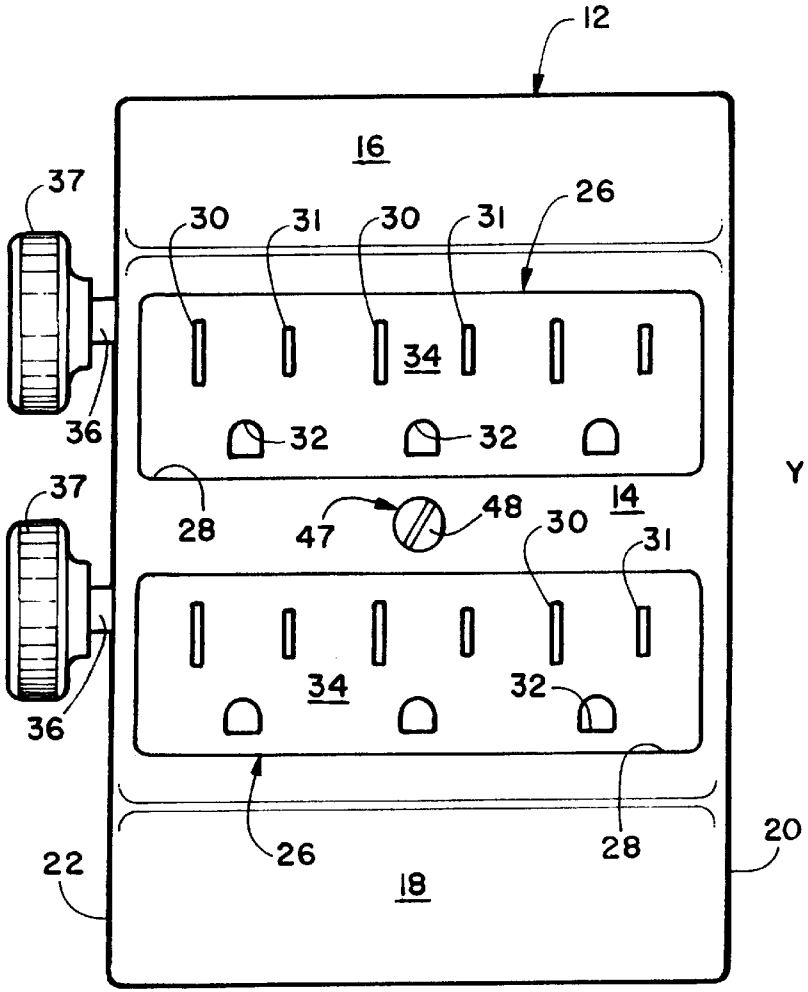
FIG. 1 is a front elevation view of a six-gang wall outlet.
Figure 3:
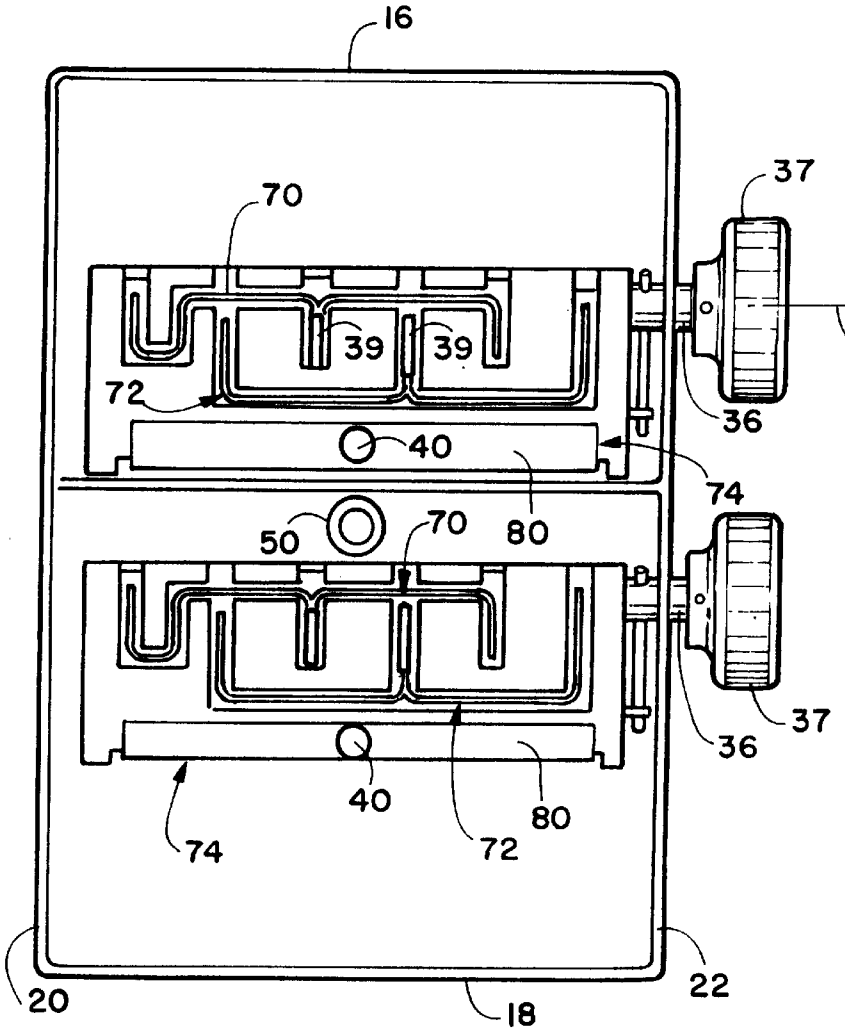
FIG. 3 is a schematic rear elevation view of the housing of the six gang wall outlet with the rear cover removed.

The novel multiple gang electrical connector assembly will now be described by referring to FIGS. 1–5 of the drawings. Illustrated in FIGS. 1–3 is a six-gang wall outlet assembly that is generally designated numeral 10. FIGS. 3A–3D and 4 primarily illustrate different components found in the housing 12.

Housing 12 has a front wall 14, a top wall 16, a bottom wall 18, a right side wall 20, a left side wall 22 and a removable rear cover wall 24. A pair of module housings 26 are mounted in openings or apertures 28 in front wall 14. In the illustrated embodiment, each module housing 26 has three pairs of laterally spaced electrical plug apertures 30 and 31 and positioned below them is a ground prong aperture. Each module housing 26 has a front wall 34. A pair of vertically spaced shafts 36 each have a knob 37 mounted on its front end.

Referring to FIG. 2, vertically spaced blade prongs 39 and ground prongs 40 are seen to extend from rear cover wall 24 and these align with the respective apertures in wall outlet electrical receptacle 42 that is mounted on wall 43. Wall outlet electrical receptacle 42 has an aperture 45 that receives the shank portion 46 of a screw 47 having a flat head 48. Screw 47 passes through a bore hole 49 in tubular member 50 and has a longitudinal X-axis. Screw 47 threads into a threaded bore of the conventional wall outlet electrical receptacle 42 to prevent accidental removal of housing 12 and also to lock it into positive engagement.

In FIG. 2, module housing 26 is shown to have a top wall 54, a bottom wall 55, a side wall 56 and a rear wall 57. Between the inside of left side wall 22 and side wall 56 are a pair of stop pins 60. A ring or annular shoulder 61 having an arm 62 is formed on shaft 36. The rotation of shaft 36 is limited by arm 62 as it travels between the respective stop pins 60. The limited amount of rotation of shaft 36 will take it through a position that allows the male prongs of a male electrical plug to be easily inserted or removed to a position where the male prongs are locked therein.

Figure 4:
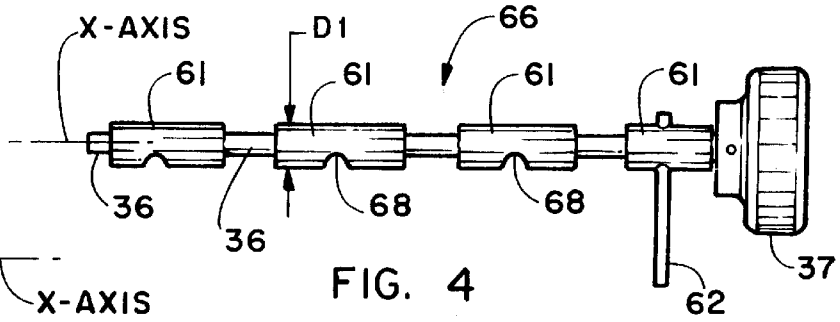
FIG. 4 is a rear elevation view of the shaft assembly.

Shaft assembly 66 is illustrated in FIG. 4. It shows a knob 37 mounted on shaft 36. It also shows a plurality of longitudinally spaced rings or annular shoulders 61 that each have a transversely extending groove or channel 68. In production, the shaft might have a diameter D1 with annular grooves spaced between what was described as rings or annular shoulders 61. Shaft 36 has an X-axis.

Figure 3A:
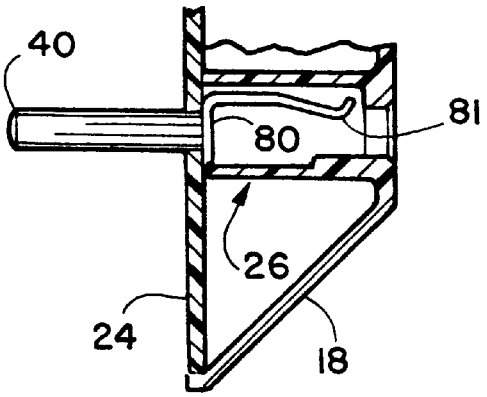
FIG. 3A is a vertical cross sectional view of the lower portion of the six gang wall outlet housing.
Figure 3B:
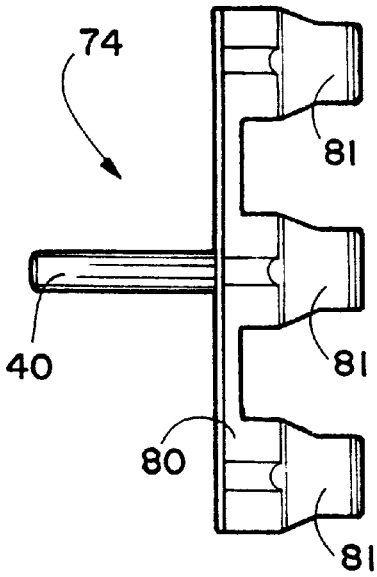
FIG. 3B is a top plan view of the ground electrical conductor bar.
Figure 3C:
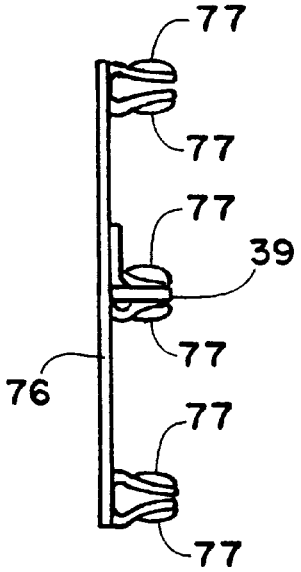
FIG. 3C is a front elevation view of one of the upper and lower electrical conductor bars.
Figure 3D:
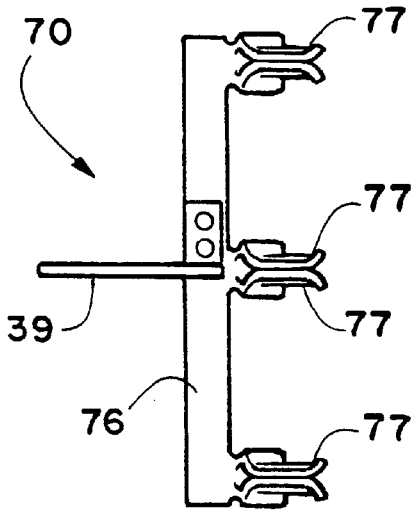
FIG. 3D is a top plan view of the electrical conductor bar shown in FIG. 3C.

FIG. 3 is a schematic rear elevation view of housing 12 with cover or rear wall 24 removed. The housing modules 26 are illustrated as being a solid block of material but it is to be understood that other structure can be utilized which would function in a similar manner. Each module has the front wall structure as illustrated in FIG. 1 and the rear wall structure as illustrated in FIG. 3. Each module would have an upper conductor bar 70 and a lower conductor bar 72 that are substantially identical. The structure of one of the upper conductor bars 70 is illustrated in FIG. 3D. Each module housing also has a ground conductor bar 74 such as illustrated in FIGS. 3A and 3B.

Electrical conductor bar 70 will now be described by referring to FIGS. 3C and 3D. Each electrical conductor bar has a metallic conductor strip 76 having laterally spaced blade prong terminals 77 extending forwardly therefrom. The embodiment illustrated has a pair of blade prong terminals that would capture the prong of a male electrical plug therebetween. However, a single blade prong terminal would be sufficient for making electrical contact with a male prong from a male electrical plug. Extending rearwardly from metallic conductor strip 76 is a blade prong 39 such as illustrated in FIG. 2.

Ground electrical conductor bar 74 will now be discussed by referring to FIGS. to 3A and 3B. It has a metallic conductor strip 80 having a plurality of forwardly extending fingers 81. Extending rearwardly therefrom is the cylindrically shaped ground prong 40.

Figure 5:
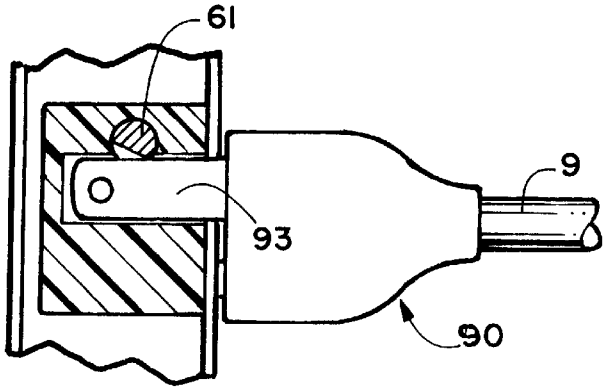
FIG. 5 is a schematic cross sectional view showing the manner in which the male electrical plug is locked in the six gang wall outlet.

FIG. 5 shows the manner in which the male electrical plug 90 on an electrical cord 92 has its blade prong 93 locked in module housing 26. Ring or annular shoulder 61on shaft 36 is shown rotated to a position wherein it provides a downward locking force against the top edge of blade prong 93. By rotating knob 37 until it reaches the other stop pin 60, the blade prong 93 would be free to be withdrawn. Ring or annular shoulder 61 has a diameter D1 and a radius R1. The X-axis of shaft 36 has to be positioned a predetermined height above blade prongs 93 so that it can be locked in position.

What is claimed is:

1. A multiple gang electrical connector assembly for detachable connection to a conventional wall outlet electrical receptacle comprising:

a housing having a front end, a rear end, a front wall, a top wall, a bottom wall, a left side wall, a right side wall and a back wall that form a chamber in said housing; a plurality of pairs of laterally spaced electrical plug apertures are formed in said front wall; at least two of said plurality of pairs of electrical plug apertures being aligned in a first horizontally oriented line;

each of said pairs of electrical plug apertures having a metallic left blade prong terminal positioned behind said front wall in said housing; said metallic left blade prong terminals being electrically connected to each other by a first metallic conductor strip to form a first conductor bar; a first blade-shaped prong is connected to said first metallic strip and it extends rearwardly therefrom and out through a first slot in said rear wall of said housing;

each of said pairs of electrical plug apertures having a metallic right blade prong terminal positioned behind said front wall in said housing; said metallic right blade prong terminals being electrically connected to each other by a second metallic strip to form a second conductor bar; a second blade-shaped prong is connected to said second metallic strip and it extends rearwardly therefrom out through a second slot in said rear wall of said housing;

a horizontally oriented first elongated shaft having a front end, a rear end, and a longitudinally extending X-axis; said front end of said first shaft extends outwardly through a bore hole in one of said side walls of said housing and said rear end being rotatably supported by structure in said housing; said X-axis being vertically positioned a predetermined distance above said electrical plug apertures in said front wall of said housing;

said shaft having locking means for gripping at least one of the male prongs of each male electrical plug that may be inserted into said respective pairs of laterally spaced electrical plug apertures formed in said front wall of said housing; and gripping means on said front end of said first elongated shaft for aiding in rotating said shaft between a locked position and an unlocked position.

2. A multiple gang electrical connector assembly as recited in claim 1 wherein said rear wall of said housing is a removable cover.

3. A multiple gang electrical connector assembly as recited in claim 1 further comprising a ground plug aperture in said front wall of said housing below each pair of laterally spaced plug apertures.

4. A multiple gang electrical connector assembly as recited in claim 1 further comprising means for limiting the arc of rotation of said first elongated shaft.

5. A multiple gang electrical connector assembly as recited in claim 1 wherein said first horizontally oriented line of pairs of electrical plug apertures is mounted in a first module housing.

6. A multiple gang electrical connector assembly as recited in claim 4 wherein said means for limiting the arc of rotation of said first elongated shaft comprises an annular shoulder on said shaft; an arm extends transversely outwardly from said shaft; a pair of spaced stop pins are mounted in said housing on opposite lateral sides of said arm to limit the travel of said arm.

7. A multiple gang electrical connector assembly as recited in claim 1 wherein said housing has a second horizontally oriented line of pairs of electrical plug apertures and said second line is vertically spaced beneath said first line.

8. A multiple gang electrical connector assembly as recited in claim 1 further comprising means for securely attaching said housing to a conventional wall outlet electrical receptacle.

9. A multiple gang electrical connector assembly as recited in claim 7 further comprising a second horizontally oriented shaft vertically positioned a predetermined distance above said second horizontally oriented line of pairs of electrical plug apertures.

10. A multiple gang electrical connector assembly as recited in claim 1 wherein said gripping means on said front end of said first elongated shaft is a knob.

11. A multiple gang electrical connector assembly as recited in claim 1 wherein said locking means comprises an annular shoulder on said first shaft for each pair of electrical apertures and said annular shoulders have a transversely extending groove on its periphery.

* * * * *